US009609919B2

(12) United States Patent
Burt et al.

(10) Patent No.: US 9,609,919 B2
(45) Date of Patent: Apr. 4, 2017

(54) TRACTION CLEAT AND RECEPTACLE

(71) Applicant: Pride Manufacturing Company, LLC, Brentwood, TN (US)

(72) Inventors: John Robert Burt, Chandler, AZ (US); Lee Paul Shuttleworth, Birmingham (GB)

(73) Assignee: Pride Manufacturing Company, LLC, Brentwood, TN (US)

( * ) Notice: Subject to any disclaimer, the term of this patent is extended or adjusted under 35 U.S.C. 154(b) by 60 days.

(21) Appl. No.: 14/132,469

(22) Filed: Dec. 18, 2013

(65) Prior Publication Data

US 2014/0165423 A1 Jun. 19, 2014

Related U.S. Application Data

(60) Provisional application No. 61/738,500, filed on Dec. 18, 2012.

(51) Int. Cl.
*A43C 15/16* (2006.01)

(52) U.S. Cl.
CPC ..... *A43C 15/161* (2013.01); *A43C 15/162* (2013.01)

(58) Field of Classification Search
CPC ... A43C 15/161; A43C 15/162; A43C 15/164; A43C 13/01; A43B 5/001; A43B 5/02
USPC . 36/61, 134, 127, 66, 67 A, 114, 67 D, 128, 36/62, 65, 67 R, 126
See application file for complete search history.

(56) References Cited

U.S. PATENT DOCUMENTS

| | | | |
|---|---|---|---|
| 5,794,367 | A | 8/1998 | Carroll |
| 5,887,371 | A | 3/1999 | Curley, Jr. |
| 5,974,700 | A | 11/1999 | Kelly |
| 6,006,454 | A | 12/1999 | Sitzler, Sr. |
| 6,023,860 | A | 2/2000 | McMullin |
| 6,041,526 | A | 3/2000 | Collins |
| 6,052,923 | A | 4/2000 | McMullin |
| 6,094,843 | A | 8/2000 | Curley, Jr. |
| 6,167,641 | B1 | 1/2001 | McMullin |
| 6,209,230 | B1 | 4/2001 | Curley, Jr. |
| 6,272,774 | B1 | 8/2001 | Kelly |
| 6,305,104 | B1 | 10/2001 | McMullin |
| 6,338,208 | B1 | 1/2002 | Waterbury |

(Continued)

FOREIGN PATENT DOCUMENTS

| | | | |
|---|---|---|---|
| JP | 3113938 | U | 9/2005 |
| WO | 2010088330 | A1 | 8/2010 |

OTHER PUBLICATIONS

International Search Report and the Written Opinion, PCT/US2013/076010, Apr. 1, 2014, 8 pages.

(Continued)

*Primary Examiner* — Clinton T Ostrup
*Assistant Examiner* — Heather Mangine
(74) *Attorney, Agent, or Firm* — Edell, Shapiro & Finnan, LLC

(57) ABSTRACT

A traction cleat applicable for use in field sports is provided with dynamic traction elements having larger radial thickness, cross-sectional area and mass than dynamic elements in golf shoe cleats. The strength of a locking arrangement for the cleat in a shoe-mounted receptacle is enhanced by providing an annular array of spaced locking stubs on the receptacle to engage a similar array of spaced locking posts on the cleat.

16 Claims, 8 Drawing Sheets

(56) References Cited

U.S. PATENT DOCUMENTS

| | | | | |
|---|---|---|---|---|
| 6,502,332 | B1 | 1/2003 | Nakayama | |
| 6,631,571 | B2 | 10/2003 | McMullin | |
| 6,810,608 | B2 | 11/2004 | Kelly | |
| 6,823,613 | B2 | 11/2004 | Kelly et al. | |
| 6,834,445 | B2 | 12/2004 | McMullin | |
| 6,834,446 | B2 | 12/2004 | McMullin | |
| 6,904,707 | B2 | 6/2005 | McMullin | |
| 6,983,556 | B2 | 1/2006 | McMullin | |
| 7,007,413 | B2 | 3/2006 | McMullin | |
| 7,040,043 | B2 * | 5/2006 | McMullin | A43B 5/001 36/127 |
| 7,073,280 | B2 | 7/2006 | Terashima | |
| 7,107,708 | B2 | 9/2006 | Kelly et al. | |
| 7,137,213 | B2 | 11/2006 | Kelly et al. | |
| 7,398,610 | B2 | 7/2008 | McMullin | |
| 7,559,160 | B2 | 7/2009 | Kelly | |
| 7,726,043 | B2 | 6/2010 | Shuttleworth et al. | |
| 7,726,047 | B1 | 6/2010 | MacNeill et al. | |
| 7,827,705 | B2 * | 11/2010 | Baucom | A43B 13/026 36/134 |
| 7,946,062 | B2 | 5/2011 | Kelly | |
| 8,020,322 | B2 | 9/2011 | McMullin | |
| 8,191,286 | B2 | 6/2012 | Krikorian | |
| 8,201,348 | B2 | 6/2012 | Kelly | |
| 8,245,422 | B2 | 8/2012 | Krikorian et al. | |
| 8,544,195 | B2 | 10/2013 | Burt et al. | |
| 8,631,591 | B2 | 1/2014 | Krikorian et al. | |
| 8,667,714 | B2 | 3/2014 | Burt et al. | |
| 8,707,588 | B2 | 4/2014 | Burt et al. | |
| 8,769,751 | B2 | 7/2014 | Burt et al. | |
| 2005/0000119 | A1 | 1/2005 | McMullin | |
| 2006/0065409 | A1 * | 3/2006 | Wu | A43C 15/161 168/23 |
| 2007/0209239 | A1 * | 9/2007 | Kelly | A43C 15/161 36/127 |
| 2009/0211116 | A1 | 8/2009 | Chen et al. | |
| 2009/0211118 | A1 | 8/2009 | Krikorian et al. | |
| 2009/0223088 | A1 * | 9/2009 | Krikorian et al. | 36/127 |
| 2010/0139129 | A1 | 6/2010 | Kuhtz et al. | |
| 2010/0257751 | A1 * | 10/2010 | Burt | A43C 15/02 36/66 |
| 2014/0101970 | A1 | 4/2014 | Krikorian et al. | |
| 2014/0165423 | A1 | 6/2014 | Burt et al. | |

OTHER PUBLICATIONS

European Supplementary Search Report, EP13864198, Jun. 30, 2016, 8 pages.

* cited by examiner

TRACTION CLEAT AND RECEPTACLE

CROSS REFERENCE TO RELATED APPLICATION

This application claims priority to U.S. Provisional Application No. 61/738,500, filed Dec. 18, 2012, by John Robert Burt et al and entitled "Traction Cleat And Receptacle", the disclosure in which is incorporated herein in its entirety by this reference.

FIELD OF THE INVENTION

The present invention pertains to footwear cleats for primary use in field sports and, more particularly, to improvements in such cleats that result in improved traction and safety without adversely impacting running speed. It is to be understood that the cleats described herein, although having particular advantages when used to enhance traction in field sports, are not limited to such use, and can be used with golf shoes and in other applications where cleats depend from the outsole of a shoe to enhance traction during walking, running, pivoting, etc. In addition, as described herein, the cleats may be removably attached to a shoe outsole or molded permanently into the outsole.

BACKGROUND

Cleats secured to footwear used in soccer, rugby, lacrosse, cricket, American football and other field sports have typically taken the form of individual replaceable hard plastic or metal studs that threadedly engage respective receptacles mounted in the outsole of an athletic shoe. Depending on player preferences and conditions, the studs typically range in length from ten millimeters to eighteen millimeters. For muddy and similar poor field conditions, longer studs are conventionally more desirable because they penetrate the ground more deeply to provide better traction. That is, it is the surface area of the stud in contact with the sod (i.e., the turf and top soil) below the ground level that engages the sod for traction during a push-off for a running step or during an attempt to stop. Therefore, more stud surface area makes contact with the sod as penetration into the sod increases. However, when studs penetrate the sod more deeply, the wearer is unable to run as fast as he/she would be able to when there is less penetration. For example, a 15 mm stud penetrates the ground only to approximately 10 mm on initial impact and, as the runner pushes off to take the next step, the downward force causes the stud to initially sink further toward the maximum 15 mm depth. This is referred to as secondary sink or penetration, the limitation of which is defined by the outsole of the shoe abutting the ground. The result of secondary penetration is a significant loss of power on the push off for each step, thereby limiting running speed. In addition, a not insignificant amount of the wearer's energy (i.e., force and time) is used in withdrawing a long stud from the muddy turf with each step.

Apart from the loss of push-off power, long studs are believed to cause many field sport injuries. The longer the stud, the more deeply anchored it becomes in the turf. When studs are deeply anchored, forces suddenly applied to ankles, legs and knees are more likely to create injuries since the stud and shoe cannot readily break away from the turf in response to sudden momentum changes of the runner and lateral impact from collisions and tackling. In other words, when the shoe does not easily break away from the turf, a portion of the leg is more likely to break or become sprained in response to lateral forces applied to a knee or leg.

It is known to provide golf shoes with plastic cleats that provide traction without penetrating the ground. This is a highly desirable characteristic for golf shoe cleats because ground penetration, particularly on putting greens, can damage the grass root system and leave uneven terrain that adversely affects the ability to accurately putt a golf ball. A highly efficient type of golf cleat for this purpose provides dynamic traction wherein traction elements on the cleat flex, typically spreading outwardly, under the load of the wearer's weight and, in doing so, provide the desired traction without ground penetration. Examples of dynamic traction cleats may be found, for example, in U.S. Pat. Nos. 6,209,230, 6,305,104 and 7,040,043, the disclosures of which are incorporated herein by reference in their entireties. In these patents, cleats are disclosed which take the form of a hub with a connector such as a threaded shaft extending from the hub top surface that can be selectively secured to a mating connector mounted in a golf shoe outsole. Plural flexible traction elements extend generally downward and outward from the hub periphery to frictionally engage the surface, become entangled with grass blades and turf, and trap grass blades against the shoe outsole, all of which combine to provide traction as the traction elements flex under the weight of the wearer. It is the flexure of the traction elements that give these cleats the name "dynamic traction cleats" and distinguish them from plastic cleats wherein the plural traction elements are inflexible, or "static", and provide only the more limited traction resulting from direct point to point contact on the ground surface.

One approach to overcoming the aforementioned disadvantages of the conventional soccer stud is disclosed in U.S. Patent Application Publication No. 2009/0211118 (Krikorian et al, U.S. patent application Ser. No. 12/393,451) wherein dynamic traction is used to reduce secondary penetration by field studs into muddy and soggy sod. Specifically, the cleat comprises a hub, a stud of substantially non-flexible material extending downwardly from a lower surface of the hub, a cleat connector extending upwardly from an upper surface of the hub, and dynamic traction elements extending downwardly from the lower surface of the hub, typically from the hub rim, and adapted to flex upwardly when the cleat is connected to a shoe. The distal end of the stud is substantially flat or slightly rounded (e.g., beveled) and extends further from the lower surface of the hub than the distal end of each unflexed dynamic traction element such that, when the shoe to which the cleat is connected is forced downward toward the ground surface, the stud contacts and/or begins to penetrate the ground surface to provide initial traction before each dynamic traction element makes contact with the ground surface. The dynamic traction elements thus reduce the secondary penetration of the stud and eliminate some of the disadvantages described above.

We have found that even the initial penetration of the stud disclosed in Krikorian et al adversely affects the speed and quickness of the wearer of the shoe because of the effort required to remove the stud from that penetration. Moreover, even the initial penetration has been found to be undesirable from a safety/injury perspective for the reasons described. It would be desirable, therefore, to utilize dynamic traction in a field cleat without a penetrating stud.

Initially, in studying the above-stated problems, we conducted experiments involving attaching to field sport athletic shoes some commercially available versions of the dynamic traction cleats disclosed in U.S. Pat. Nos. 6,305,104 (available commercially as BLACK WIDOW® cleats under the SOFTSPIKES® brand) and 7,040,043 (available commercially as PULSAR® cleats under the SOFTSPIKES® brand). It was found in field sports tests that traction was not as reliable as desired because the dynamic traction elements did not efficiently entangle with and trap grass blades in response to sudden starts, stops and directional changes by the player wearing the shoe. Moreover, it was also discovered that the dynamic traction elements were becoming damaged in response to the shear and torsional stresses produced by those sudden momentum changes.

Further, in some instances the attachment between the cleat and the receptacle was compromised in response to sudden momentum changes. Specifically, the BLACK WIDOW and PULSAR cleats employ the very reliable FAST TWIST® locking system of the type disclosed in U.S. Pat. Nos. 6,810,608 and 7,107,708. In that system a circular array of locking posts are angularly spaced and uniformly arranged about the cleat hub. The receptacle is provided with a continuous ring of multiple adjacent locking teeth of generally triangular configuration such that the apices of successive teeth click past the interfering locking posts and then more firmly engage the locking posts as the threaded engagement between the cleat and receptacle is tightened (i.e., as the threaded cleat stem is rotated further into the threaded receptacle socket). Although this arrangement functions perfectly when used in golf shoes, we found that the engagement between the posts and teeth is often compromised when subjected to the stresses of sudden starts, stops and turns experienced by shoes used in field sports.

It is desirable, therefore, and an object of the invention, to provide a cleat and cleat receptacle that utilize dynamic traction effectively, reliably and safely when used in field sports shoes.

SUMMARY OF THE INVENTION

In accordance with one aspect of the invention the radial thickness of the dynamic traction element (i.e., in the dimension radially outward from the traction element central longitudinal axis) is substantially increased to enlarge the cross-sectional area of the traction element and the mass of polymer contained therein as compared to the dynamic traction elements on commercially available golf cleats. The cross-sectional area of the traction element may be taken in any plane that is generally perpendicular to a line extending longitudinally through the traction element sections. Although increasing the angular width of the traction elements would also increase the cross-sectional area of the traction element and possibly increase its strength, doing so would reduce the space available for traction elements. We have found that if the radial thickness is increased sufficiently to prevent traction element damage from expected shear and torsional stresses, but not so much as to prevent sufficient flexure of the element to enable it to spread outwardly to engage turf surfaces and grass blades and to also trap grass blades against a shoe outsole, the resulting dynamic traction is more efficient and effective than what is provided by conventional penetrating studs. In particular, we found that providing a cross-sectional area of at least twenty square millimeters throughout the traction element length provides a significant increase in traction element strength. In a preferred and optimum embodiment the traction element was provided with a transverse section that varies throughout its length and was at least thirty square millimeters at its thickest part. This compares, for example, to the BLACK WIDOW® golf cleat wherein the transverse cross-sectional area at the thickest section of the traction element is on the order of fourteen square millimeters.

By increasing the radial thickness of the traction element, the resulting increase of thermoplastic material forming the traction element, and thereby the increase in traction element mass, is also substantial. In particular, the volume of polymer forming each traction element in the aforesaid preferred and optimum embodiment is approximately one-hundred-ninety-seven cubic millimeters; this is in comparison to a volume of approximately sixty-two cubic millimeters for the traction element in the BLACK WIDOW® golf cleat.

The radial thickening of the traction element also includes an increase in the surface area of its turf-engaging distal end. In the aforementioned preferred and optimum embodiment, that surface area is approximately 15.6 $mm^2$; the corresponding surface area for the BLACK WIDOW® golf cleat is approximately 4.1 $mm^2$. This almost fourfold increase in surface area for each traction element has proven effective in increasing traction resulting from surface friction as the traction elements flex outwardly under weight load and push the contact surfaces of the traction elements along the turf.

The thusly improved dynamic traction elements are able to resist damaging torsional and shear stresses when entangled with grass blades and when forced against the turf, yet they provide the desired reliable and effective dynamic traction without safety risks to the athlete resulting from ground penetration. Importantly, traction for this cleat is provided by the dynamic elements tangling with grass and trapping grass against the outsole, and by ground surface friction, not by penetration into the ground. The result of this construction is that the cleat releases from its engagement with the turf at very close to the same shear forces for every step, irrespective of the weight of the athlete wearing the shoe. This may be compared to cleats having a central stud in combination with surrounding dynamic elements wherein the stud digs into the ground to a depth determined by the wearer's weight, thereby rendering the traction weight dependent.

In some instances it may be desirable to provide support for the dynamic traction elements in addition to that provided by the enhanced thickness. In such cases a central wear pad may be provided to extend from the bottom surface of the hub with an axial length shorter than that of the dynamic elements so as to minimize damage to the dynamic elements from full flexure extension on hard surfaces such as cement walkways. The axial length of the wear pad is selected such that, in response to downward force by the foot of the wearer of the shoe, the dynamic elements initially contact the ground and deflect sufficiently to engage and trap grass blades against the shoe sole just as the wear pad contacts the ground. In other words, the wear pad is prevented by the dynamic elements from penetrating turf and does not interfere with the tractional effects provided by the dynamic elements or contribute significantly to the tractional forces provided by dynamic elements. Wear pads, per se, are well known and may take the shape of a short vertical projection with a flat or rounded distal end, a spherical segment, a plurality of spaced projections from the bottom of the hub with rounded or flat distal ends, etc.

On the other hand, we have found that the overall tractional effect improves as the wear pad is made shorter to permit the dynamic legs to fully flex. Therefore, there is tradeoff between tractional force improvement and the protection of the dynamic elements on hard surfaces. Specifically, the traction provided by the cleat on grass (artificial or natural) results from the dynamic elements spreading outwardly to both become entangled with grass blades and to trap grass blades against the outsole, as well as surface friction at the point of turf contact; the greater the spreading, the greater the traction. Thus, if wear pad projection is provided, its length must be selected sufficiently shorter than the downward projection of the unflexed dynamic elements to permit the elements to maximally flex and optimize tractional effects. In addition, the wear pad projection must be sufficiently short and properly configured to prevent it from penetrating the ground under user weight loading.

Another feature of the present invention is the recognition that in field sports such as soccer, rugby, etc., the traction requirements differ significantly at different locations of the outsole. As a consequence, some or all of the cleats, depending on their attachment locations on the shoe outsole, may have a combination of dynamic and static elements, or only dynamic elements, or only static elements. In addition, separate static elements may project from the shoe outsole at locations adjacent dynamic elements on a cleat to protect the dynamic elements on hard surfaces in a manner similar to a wear pad.

It is also within the scope of the invention to have the radially thickened traction elements extend from the cleat hub outwardly and down (i.e., diverging downwardly from the cleat axis), straight down or, in some cases, inwardly down (i.e., converging downwardly toward the cleat axis) to achieve the desired traction effects.

A further feature of the invention is the enhanced strength of the attachment system and locking arrangement by which the cleat is retained in the receptacle mounted in the shoe outsole. In this regard the continuous ring of multiple triangular locking teeth of the aforementioned FAST TWIST® system that is used in connection with golf shoes is replaced by an annular series of angularly spaced locking stubs having increased angular length. The number of stubs is equal to the number of locking posts, and the stubs are configured such that, in the locked position of the cleat in the receptacle, each stub is positioned between and abuts or is engaged by two locking posts. The side edges of the posts and stubs are configured to permit the posts to readily pass along the stubs during insertion of the cleat in a first rotational direction but to strongly resist passage of the posts when rotation is attempted in the opposite direction. The greater mass and edge configuration of the stubs, as compared to triangular configuration and lesser mass of the prior continuous array of multiple locking teeth, provides for enhanced strength in the locking function.

In the preferred embodiment of the invention attachment of the cleat and receptacle is effected by a two-start threaded engagement between an externally threaded stem projecting from the cleat hub and a corresponding threaded socket in the receptacle.

The above and still further features and advantages of the present invention will become apparent upon consideration of the following definitions, descriptions and figures of specific embodiments thereof wherein like reference numerals in the various drawings are utilized to designate like components. While these descriptions go into specific details of the invention, it should be understood that variations may and do exist and would be apparent to those skilled in the art based on the descriptions herein.

DETAILED DESCRIPTION

Figure 1:
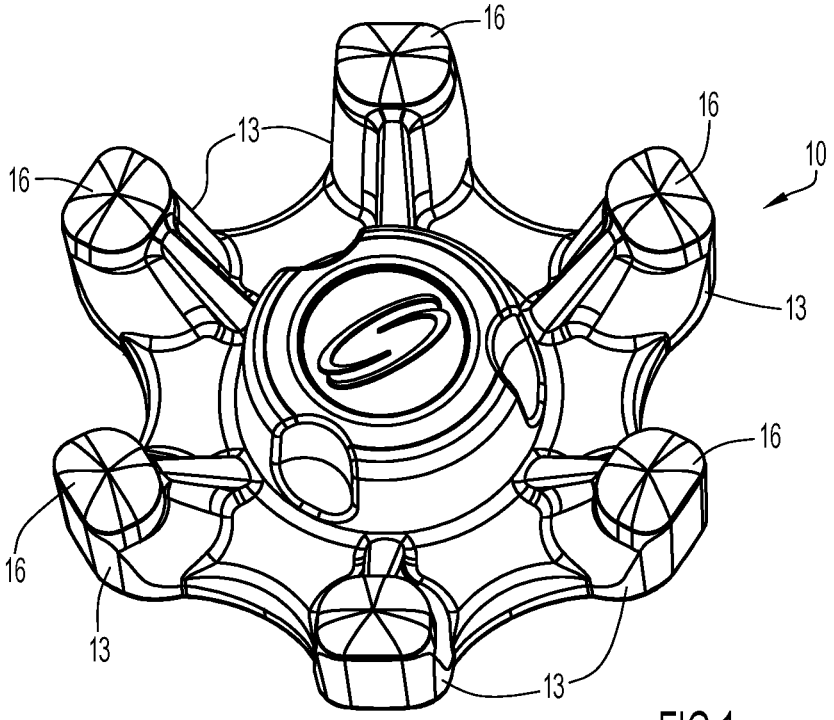
FIG. 1 is view from below in perspective of a first embodiment of a traction cleat according to the present invention.
Figure 2:
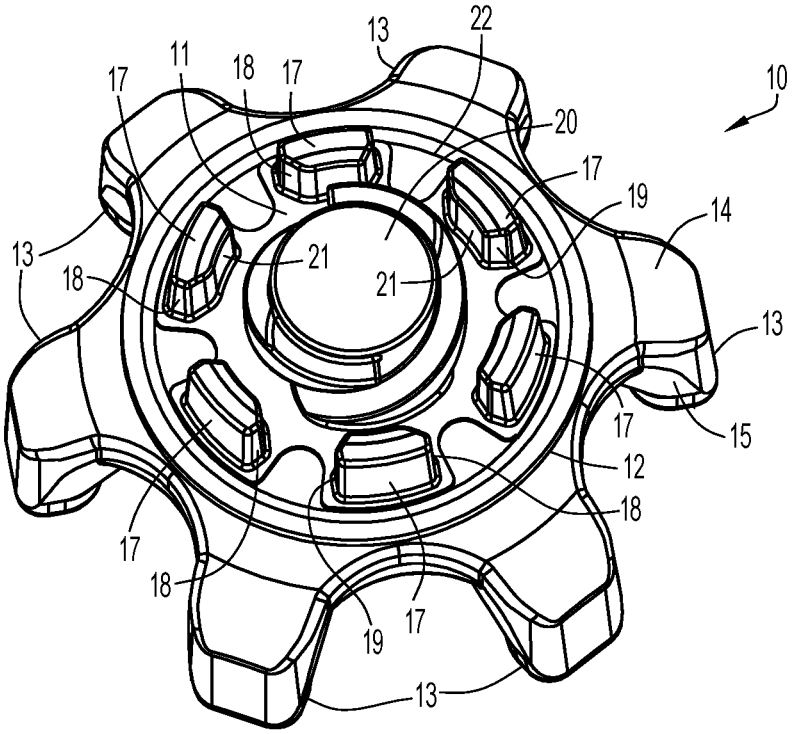
FIG. 2 is a view from above in perspective of the traction cleat of FIG. 1.
Figure 3:
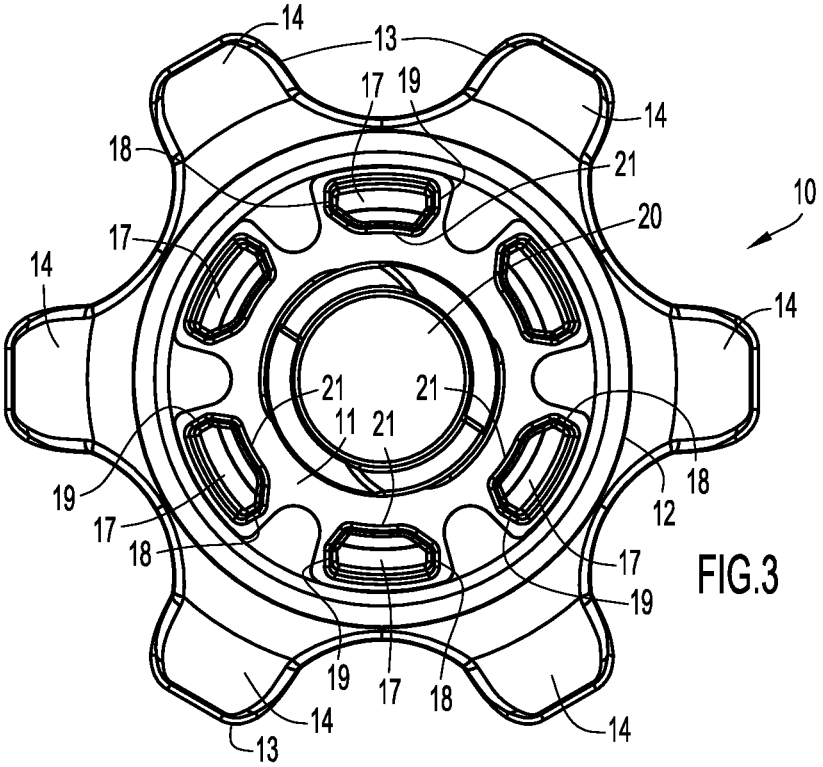
FIG. 3 is a top view in plan of the traction cleat of FIG. 1.
Figure 4:
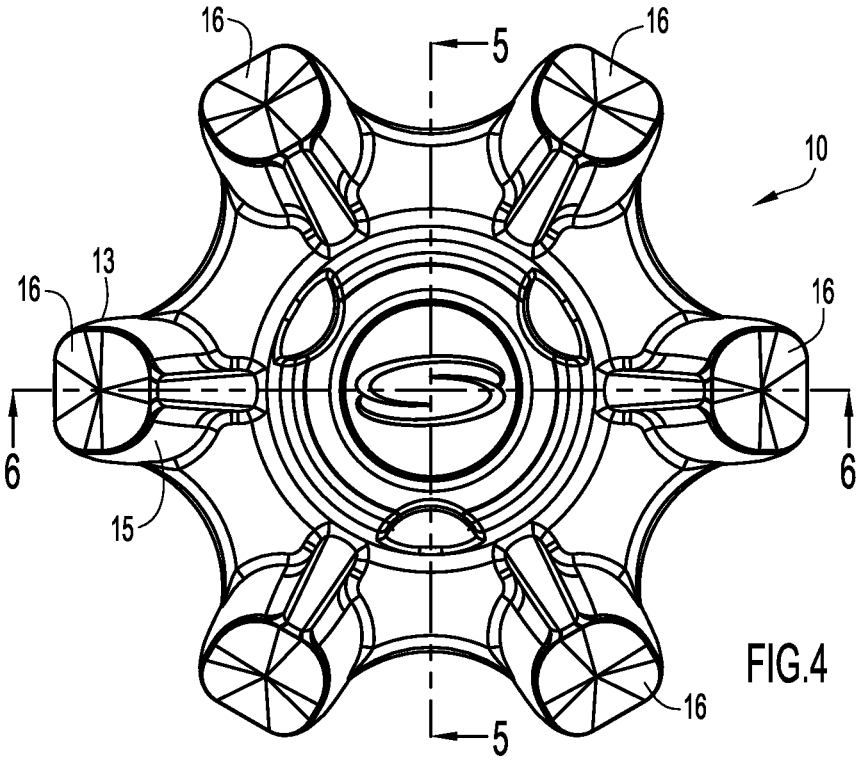
FIG. 4 is a bottom view in plan of the traction cleat of FIG. 1.
Figure 5:
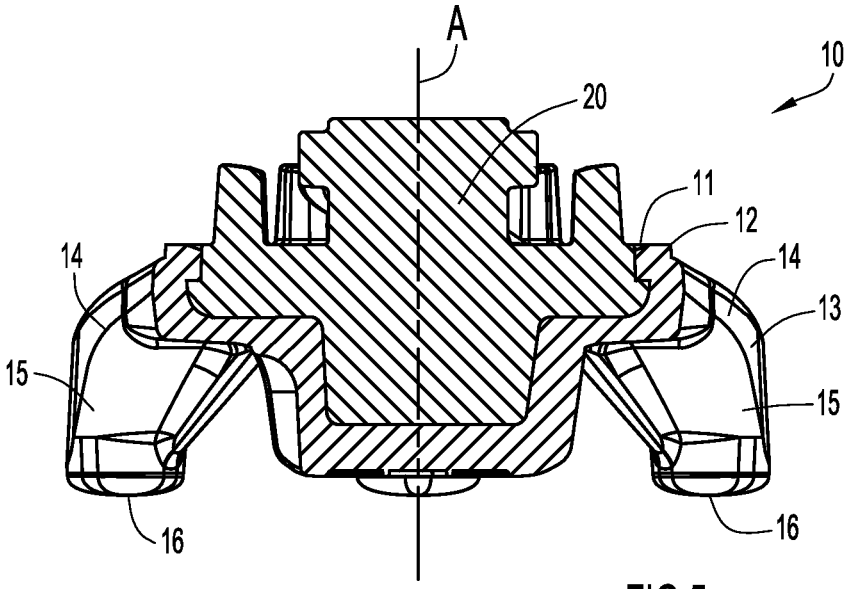
FIG. 5 is a first view in elevation and partial section of the cleat of FIG. 1, taken along lines 5-5 of FIG. 4.
Figure 6:
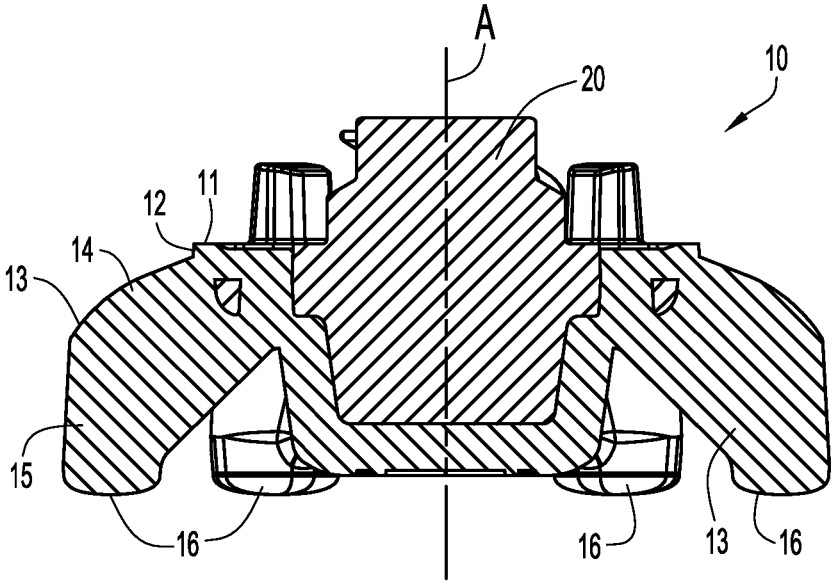
FIG. 6 is a second view in elevation and partial section of the cleat of FIG. 1, taken along lines 6-6 of FIG. 4.
Figure 7A:
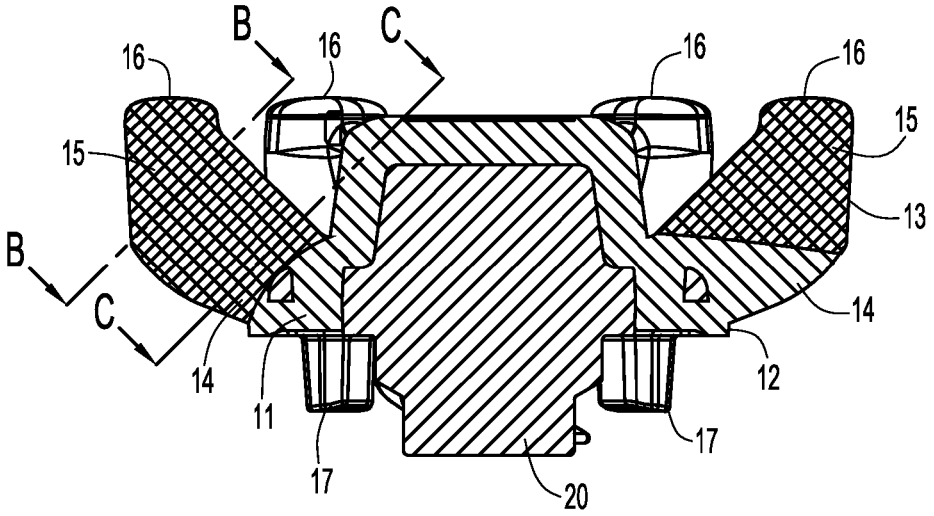
FIG. 7A is a view in section similar to FIG. 6 but showing traction elements in separate shading.
Figure 7B:
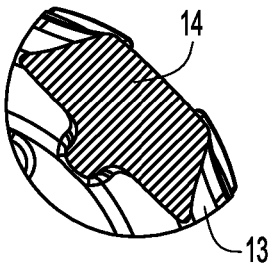
FIG. 7B is a view in section taken transversely of a traction element leg along lines B-B of FIG. 7A.
Figure 7C:
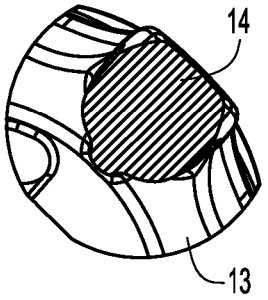
FIG. 7C is a view in section taken transversely of a traction element leg along lines C-C of FIG. 7A.

Referring specifically to FIGS. 1-7, a cleat 10 has a threaded attachment stem 20 projecting from the top surface of a hub 11 about a cleat longitudinal axis A for attachment to a receptacle described below in connection with FIGS. 8-11. In the preferred embodiment of the cleat the thread on the stem is a two-start thread. The hub 11 in the preferred embodiment is generally circular and concentric about axis A and is defined within an annular perimetric edge 12. A plurality of angularly spaced dynamic traction elements 13 have proximal ends secured at or near edge 12 and extend outward and downward therefrom. Specifically, each traction element 13 includes a proximal section 14 extending outward and slightly downward from a respective location substantially at edge 12, and a distal section 15 extending substantially downward from the distal end of the proximal section 14. The distal section terminates in a turf-engaging end surface 16 which is slightly convex and devoid of sharp corners or edges. The dynamic traction elements 13 are sufficiently flexible relative to the hub as to be pivotally flexible in an upward direction about perimetric edge 12 when subjected to the weight of a typical person wearing a shoe in which the cleat is installed.

A set of six locking posts 17 are disposed in angularly spaced relationship in an annular array located concentrically about the cleat axis A. Each locking post has a radially inward facing surface 21 disposed between first and second end surfaces 18, 19, respectively. A radially outer surface joins the outer edges of the end surfaces. Posts 17 project perpendicularly upward (i.e., axially) from the top surface of hub 11. Each end surface 18, 19 is provided in two discrete segments, a first or rearward segment that extends perpendicularly inward from the outer surface, and a second or forward segment that bends at an angle forwardly from the rearward segment and intersects inward facing surface 21. The angle of the bend between segments in end surface 18 (e.g., on the order of 45°) is considerably sharper than the angle of the bend between segments in end surface 19 (on the order of 65°) so as to provide a shallower angular slope at what serves as the leading edge of the post. As described in more detail below, the shallow slope facilitates rotational passage of the posts past locking stubs on the receptacle as the cleat is rotationally installed in the receptacle. The steeper slope at the radially forward segment of end surface 19 serves as the trailing edge and provides a greater impediment to rotation of the cleat in the direction opposite the insertion direction.

The top surface of the locking posts preferably slopes slightly (i.e., on the order of 16° in the preferred embodiment) from the leading end to the trailing end. The axial height of the posts in the preferred embodiment is nominally approximately 3.05 mm, and the radial thickness of the posts is approximately between one and two millimeters. As shown in the drawings the six spaces 22 between the six posts 17 may comprise annular recesses or cutouts in the perimetric edge 12 of the hub so as to reduce the amount of polymer material required for the hub.

The radial thickness of the traction elements 13 throughout their lengths is substantial; it is sufficient, in fact, to prevent traction element damage from expected shear and torsional stresses when used in connection with field sports. However, the radial thickness is not so great as to prevent sufficient flexure of the element to enable it to spread outwardly to engage turf surfaces and grass blades and to also trap grass blades against a shoe outsole. In particular, although the traction element has a varying peripheral contour along its length, it is radially thicker at every point along its length than the traction elements provided on cleats used with golf shoes. Consider, for example, the cross-section of the traction element illustrated in FIG. 7B, taken along lines B-B in FIG. 7A, wherein the cross-sectional area is approximately twenty-five square millimeters (actually, 25.45 $mm^2$ in a preferred embodiment). The corresponding cross-section of the aforementioned commercially available BLACK WIDOW® golf cleat has an area of only 11.77 $mm^2$. Consider next the section of the traction element illustrated in FIG. 7C, taken along lines C-C in FIG. 7A, wherein the cross-sectional area is approximately thirty-two square millimeters (actually, in the preferred embodiment, 32.07 $mm^2$). The corresponding section of the aforementioned BLACK WIDOW® golf cleat has an area of only 13.78 $mm^2$. For purposes of the present invention, the required functions as described herein are achieved where the traction element has a transverse cross-sectional area that varies throughout its length and is at least twenty square millimeters and preferably has a maximum cross-sectional area of at least thirty square millimeters.

Another feature of the cleat that enhances traction for field sports, particularly traction resulting from surface friction, is the relatively large turf-engaging end surface 16. Specifically, in the preferred embodiment the area of surface 16 is approximately fifteen square millimeters (actually, in the preferred embodiment, 15.65 $mm^2$). The corresponding surface of the aforementioned BLACK WIDOW® golf cleat has an area of only 4.14 $mm^2$.

As noted above, increasing the thickness of the traction element in the radial dimension of the cleat results in an increase of the amount of thermoplastic material forming the traction element and, thereby, an increase in traction element mass. In the preferred embodiment the volume of material in the traction element is approximately one-hundred-ninety-seven cubic millimeters; this is in comparison to a volume of approximately sixty-two cubic millimeters for the traction element in the BLACK WIDOW golf cleat.

Referring to FIGS. 8-11 in greater detail, there is illustrated a receptacle 30 that is configured to receive, engage and securely lock in place the cleat of FIG. 1 described above. With the exception of the locking stubs and the two-start thread described below, receptacle 30 is conventional in its configuration and includes a base 31 having a bottom surface 33 and a top surface 32. The base is generally rectangular with rounded corners but can be otherwise configured, symmetrically or asymmetrically about receptacle attachment axis B. When cleat 10 is installed in receptacle 30, cleat axis A and receptacle axis B are coaxially positioned. An outer portion of base 31 has a plurality of mounting slots defined longitudinally therethrough for securing the receptacle in a shoe sole. More particularly, mounting of the receptacle in the shoe outsole is effected by methods well known in the art and may include forming the outsole material around the mounting slots, or compression molding such as the process disclosed in U.S. Pat. No. 6,248,278 (Kelly), etc. A generally cylindrical hollow boss 34 projects from bottom surface 33, centrally on the base, and defines a hollow generally cylindrical interior or cavity 35 disposed concentrically about the receptacle longitudinal axis B. The distal end wall 36 of the boss is open to provide access to the cavity. The interior wall of the cavity is threaded with a two-start thread configured to receive and threadedly engage the cleat stem 20.

Boss 34 projects perpendicularly from the top surface of the base plate. The outer cylinder is open at one end and closed at its base. Concentrically disposed about the boss is an outer cylinder. An annular receiving space is defined between the boss and outer cylinder, the distal annular lower edges of which are coplanar. The threaded boss socket extends deeper into the body of the base than does the annular receiving space between the boss and outer cylinder, thereby providing more depth for the threaded socket which increases the strength of its threaded engagement to resist the high sheer forces experienced in field sports.

Six equally angularly spaced locking stubs 40 are disposed in an annular array on the radially outer surface of the cylindrical boss 34. The angular spacing between the stubs in the preferred embodiment is approximately 22° and each stub subtends an angle of approximately 38°; the radial thickness of the stubs is approximately 1.0 mm. Each stub includes a radially outer face 41 and two end walls, 42, 43 subtending different respective angles with the outer surface of boss 34 from which the stubs project. Specifically, the angle between end wall 42 and the boss outer surface is greater than the angle between end wall 43 and that surface, so that the slope presented by that end wall to ends and edges of locking posts 17 on cleat 10 is shallower than the steeper slope presented by end wall 43.

An important aspect of the locking arrangement provided for cleat 10 and receptacle 30 is that the stubs 40 are angularly spaced from one another with angular gaps along the outer surface of boss 34. This is as opposed to having an end of one stub in contact or in immediate adjacency with the next stub in the array as is the case when a ring of sequentially connecting locking teeth are provided in the aforementioned FAST TWIST® arrangement. In addition, the mass of the stubs 40, by virtue of their larger size as compared to the prior locking teeth, renders the stubs more resistant to disengagement of the cleat and receptacle.

The outward facing surface 41 of each stub 40 is slightly convex with a radius of curvature about receptacle axis B. The inward facing surface 21 of each cleat locking post 17 is slightly concave with a radius of curvature about cleat axis A. Outward facing surface 41 of the stub is at a radial distance from post axis B that is slightly greater (e.g., by approximately one millimeter) than the radial distance of surface 21 of each post from cleat axis A. This results in an interfering engagement between these surfaces when they are angularly (i.e., rotationally) aligned. The posts 17 are somewhat rigid but sufficiently flexible to be able to bend slightly radially about their bases as the posts rotationally pass the stubs during insertion of the cleat in the receptacle. The shallow sloping leading ends 18 of the post and shallow sloping leading end walls 42 of the stubs facilitate rotation as these surfaces engage and gradually force the post flexure during insertion rotation. Once the posts pass the stubs and reside in angular alignment with the spaces between the stubs, the posts return to their nominal shapes. When stem 20 is fully threadedly inserted in cavity 35, the stem distal end abuts the closed end of the cavity and the entire axial lengths of the posts are fully inserted. It is in this final insertion position that the steeper angled trailing ends of the posts and stubs fully abut along their axial lengths and preclude mutual rotation between the cleat and receptacle in a direction opposite to the insertion direction.

More specifically, in attaching the cleat 10 to receptacle 30, externally threaded cleat stem 20 is rotated in internally threaded receptacle cavity 35 until the entire stem is received in the cavity. As the stem is rotated about axes A and B in the cavity, posts 17 are angularly forced past successive stubs 40. Initially, the shallow sloped leading ends 18 of posts 17 are readily rotated past the shallow leading end walls 42 of stubs 40 with more and more of the axial lengths of the posts and stubs engaging as rotation continues. When the stub 20 is fully axially inserted, each post resides at least partially radially inserted into a respective space between two stubs, and each trailing end wall 43 abuts the trailing end surface 19 of a respective post and resists rotation opposite the insertion direction. With each passage of the posts past the stubs during insertion, the installer receives both tactile and audible "click" indications (i.e., provided by the posts being forced resiliently past a stub and into the next recess). In addition, since more of the axial length of the posts is engaged and resiliently deformed during each stub pass, the rotational force required is greater for successive steps. As a consequence, the installer is made readily aware when a cleat is partially or fully inserted.

Figure 8:
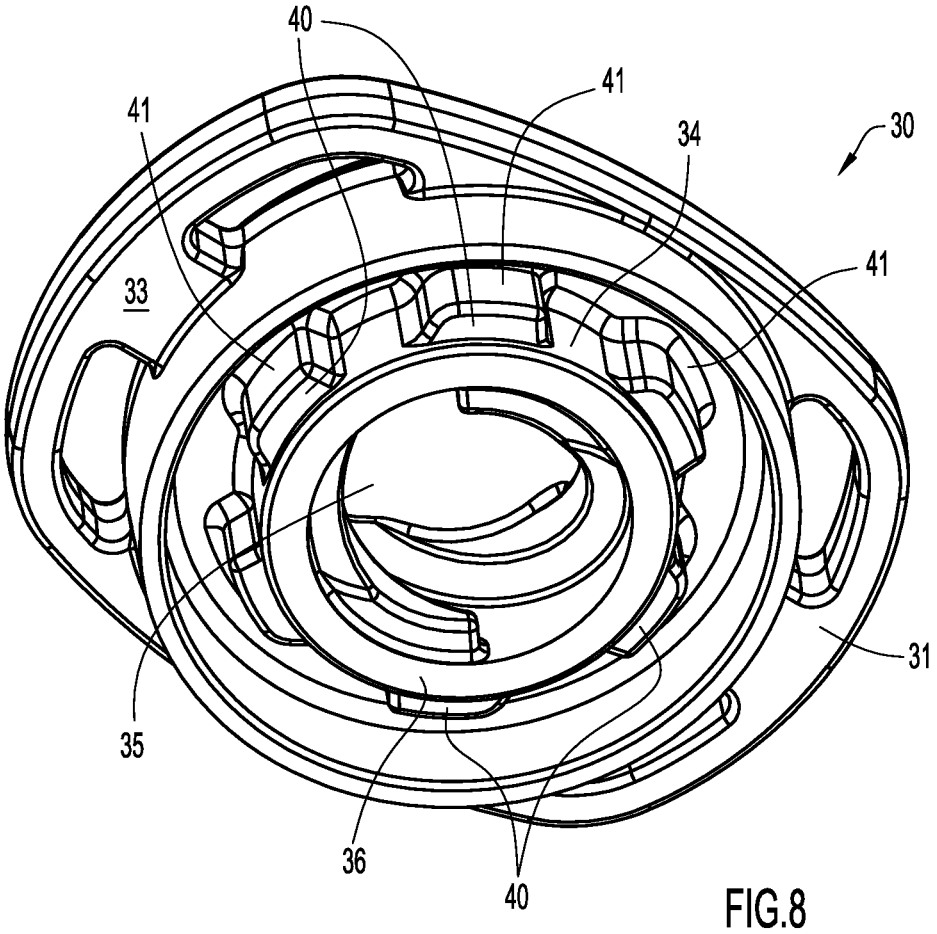
FIG. 8 is a view from below in perspective of a receptacle for receiving the cleat of FIG. 1 according to the present invention.
Figure 9:
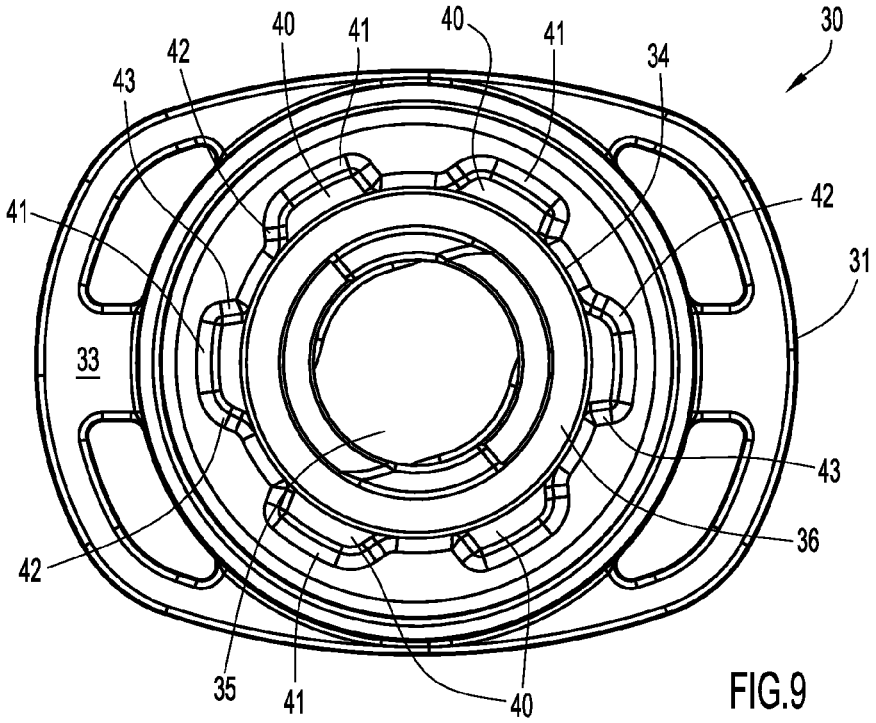
FIG. 9 is a bottom view in plan of the receptacle of FIG. 8.
Figure 10:
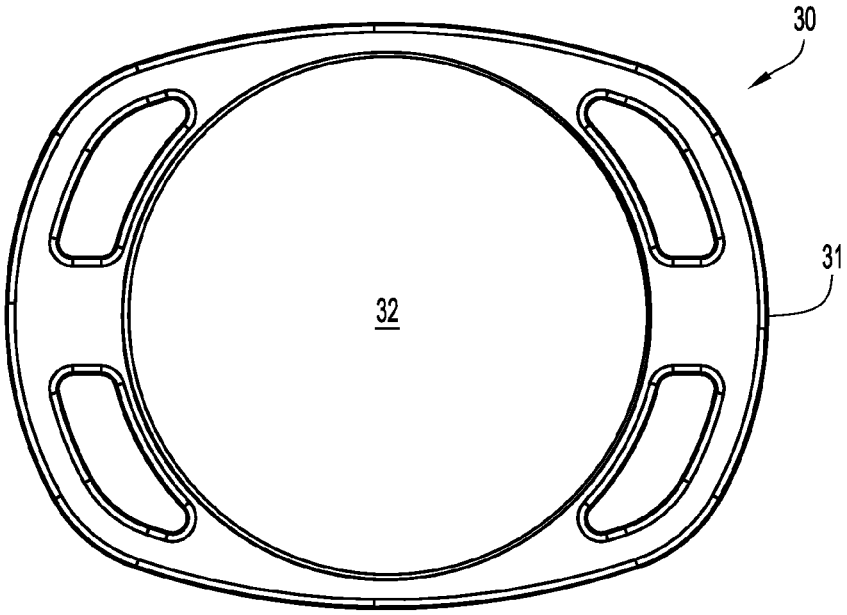
FIG. 10 is a top view in plan of the receptacle of FIG. 8.
Figure 11:
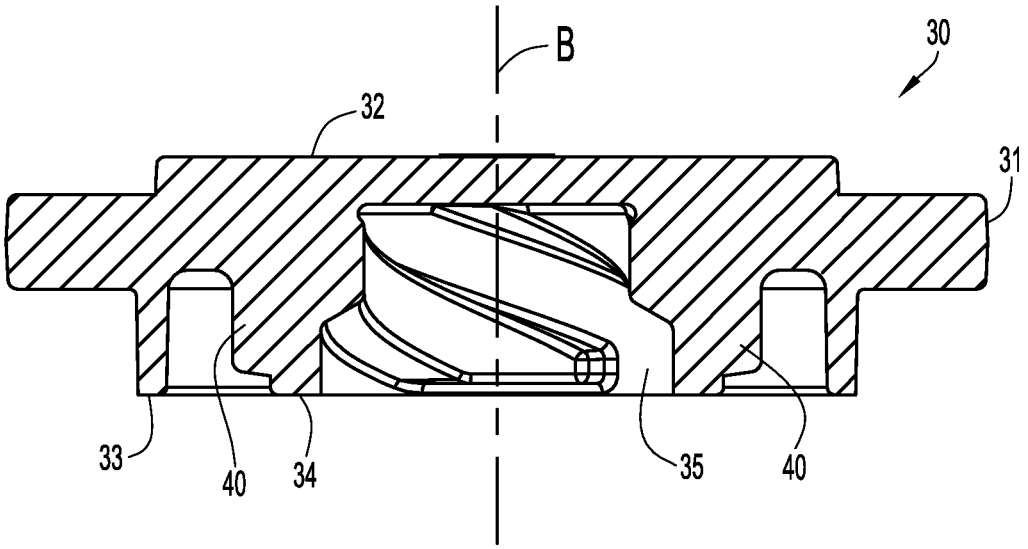
FIG. 11 is an elevation view in section of the receptacle of FIG. 8.
Figure 12:
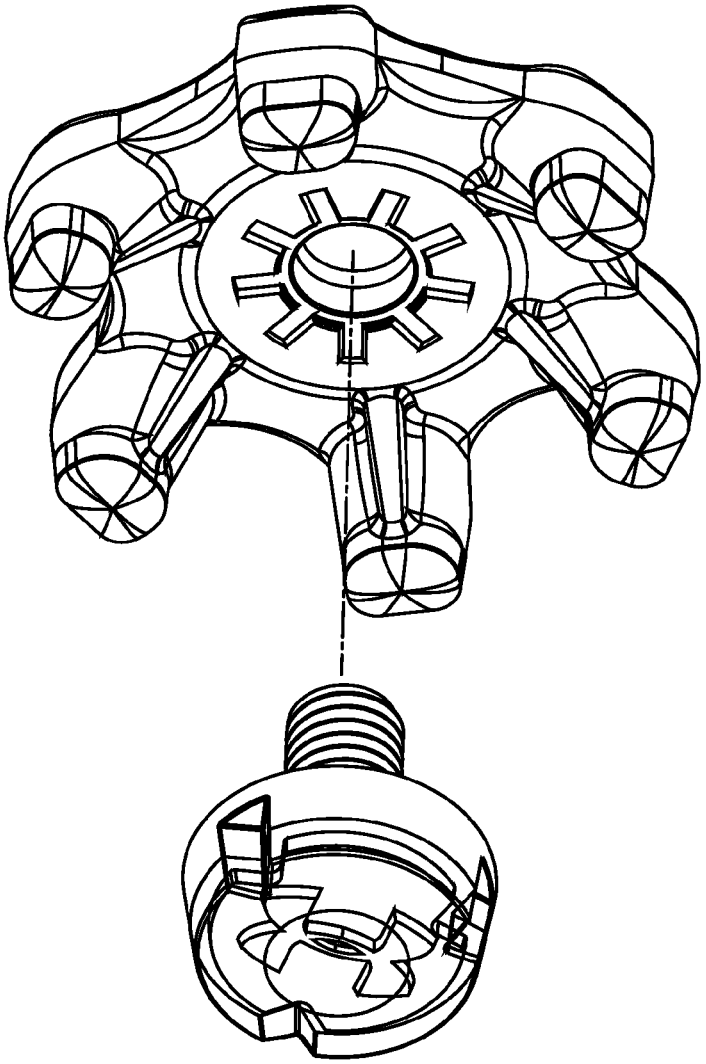
FIG. 12 is an exploded view in perspective of a second embodiment of a traction cleat according to the present invention.

The cleat illustrated in FIG. 12 is in two parts, the cleat structure itself and a threaded attachment stud which extends through a central aperture in the cleat hub, such as that illustrated in FIG. 8, to threadedly engage a receptacle mounted in the outsole of a shoe. This type of attachment is well known in the art and is exemplified by the attachment system illustrated and described in U.S. Patent Application Publication No. 2009/0211118, the entire disclosure from which is incorporated herein by reference. It is to be understood that the attachment stud may also be an integral part of the cleat and configured to extend upwardly from the top surface of the hub.

It should be noted that the traction elements 13 of cleat 10 need not be segmented into angularly oriented arm and leg portions but instead can be formed as a single straight section appropriately angled downwardly and outward from the hub. The important feature is the large radial thickness and resulting mass that protects the traction element against damage while still permitting flexure to achieve dynamic traction. Specifically, we have found that increasing the dynamic traction element radial thickness throughout most of its length, relative to the element thickness in the BLACK WIDOW® and PULSAR® cleats, by at least twenty percent and even more than sixty percent, produces these desired results. In addition, each dynamic leg may include a generally triangular reinforcing gusset extending inward from its interior facing surface to the bottom surface of the hub in a conventional manner to enhance the strength of the leg.

The specific dimensions described herein are for a preferred embodiment of the cleat and provide the necessary thickness to optimize traction while minimizing damage to those traction elements. Those dimensions are provided only as examples of preferred embodiments and are not, of themselves, to be taken as limiting the scope of the invention which is to be determined by the attached claims.

The commercial version of the FAST TWIST® locking system referred to hereinabove as used with golf cleats typically employs a three-start thread. The reason for using a two start thread in the present invention is related to the fact that the threaded center post in the present invention is longer than in the standard FAST TWIST® system. This adds strength to the engagement to combat the higher stresses experienced in fields sports. However, it is desirable to minimize the rotation of the cleat in the receptacle to 90° or 120° achieve full insertion of the cleat. In order to accommodate these competing requirements without increasing the height of the overall attachment system (i.e., receptacle and cleat attachment section), the number of threads was reduced to two and the threads were made stronger. Specifically, as compared to the standard FAST TWIST® system, the height of each thread has been increased by twenty-eight percent while maintaining the same system height and providing for a quarter turn (90°) installation. In addition, the thread core in the present system is larger by seven percent to provide greater strength and stiffness. This has been accomplished by increasing the outside diameter of the socket by only three percent, thereby keeping the overall design extremely compact.

Although the combination of relatively large dynamic traction element mass and the locking system provided between the cleat and receptacle described herein functions particularly well for field sport shoes using replaceable cleats, it should be noted that the cleat of the present invention may also be permanently molded or otherwise formed as part of the outsole of a shoe. In such an embodiment the molding of the cleat into the shoe outsole provides the connection strength and the large mass of the dynamic traction elements provides the required traction with sufficient strength to substantially reduce the risk of damage to the traction elements by shear and similar forces during field sports use. When the cleat is molded into the shoe outsole, the dynamic elements may extend downwardly from the bottom surface of the outsole, or the cleat may include a hub of different material from the outsole and which is co-molded to reside substantially flush with the outsole bottom surface with the dynamic traction elements extending from that hub as described herein for the replaceable cleat.

The relative terms "top", "bottom", "upper", "lower" "above", "below", "forward", "rear", "height", "length", "width", "thickness", and the like as used herein are for ease of reference in the description to merely describe points of reference and are not intended to limit any particular orientation or configuration of the described subject matter.

Having described preferred embodiments of new and improved traction cleat and receptacle and various novel components thereof, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A traction system for an athletic shoe having an outsole, said system comprising:

a traction cleat having a cleat axis and comprising:

a hub having an annular perimetric edge, a top surface and a bottom surface;

a hub connection member extending from said top surface and disposed about said cleat axis;

a plurality of spaced dynamic traction elements, each including a proximal section extending outward and slightly downward from a respective location substantially at said perimetric edge, and a distal section extending substantially downwardly from said proximal section, said distal section terminating in a turf-engaging end surface, said dynamic traction elements being sufficiently flexible relative to said hub as to be pivotally flexible in an upward direction about said perimetric edge when subjected to the weight of a person wearing the athletic shoe;

a set of locking posts disposed in angularly spaced relationship in an annular array located concentrically about the cleat axis, each locking post having an outer surface and a radially inward facing surface disposed between first and second end walls, said inward facing surface having a length and said end walls being oriented approximately perpendicular to said radially inward facing surface, wherein said inward facing surface is slightly concave with a continuous radius of curvature about said cleat axis throughout the length of the inward facing surface;

a receptacle having a receptacle axis configured to be secured in the shoe outsole and comprising:

a generally cylindrical hollow boss defining a socket for rotatably receiving and engaging said hub connection member when said cleat axis and receptacle axis are coincident; and a plurality of locking stubs disposed in equally angularly spaced relationship with angular gaps therebetween in an annular array extending along an outside surface of said boss concentrically about the receptacle axis, wherein each locking stub includes a radially outward facing surface disposed between outwardly projecting leading and trailing end walls, wherein said outward facing surface is slightly convex with a continuous radius of curvature about said receptacle axis;

wherein said cleat has a predetermined final engagement position in relation to said receptacle in which said connection member is fully inserted in said socket;

wherein the number of locking posts in said set is the same as the number of locking stubs in said plurality;

wherein the entire outward facing surface of each locking stub is at a radial distance from the receptacle axis that is slightly greater than the radial distance of the entire inward facing surface of each locking post from said cleat axis to provide an interfering engagement between each inward facing surface and a corresponding outward facing surface when those surfaces are angularly aligned; and wherein said locking stubs and locking posts are configured to facilitate rotational passage of said locking posts past said locking stubs as the cleat is rotationally installed in the receptacle such that in said final engagement position of said cleat:

each locking stub is angularly aligned with and extends at least partially into a space between two respective locking posts;

the leading and trailing end walls of said each locking stub substantially abut the second end wall of one of said two locking posts and the first end wall of the other of said two locking posts, respectively; and wherein said proximal section of each traction element has a transverse cross-sectional area that varies throughout its length and is between at least twenty square millimeters and thirty square millimeters at a thickest part of said proximal section.

2. The traction system of claim 1, wherein said turf-engaging end surface of each traction element has a surface area of at least twelve square millimeters.

3. The traction system of claim 2, wherein said turf-engaging end surface has a surface area of at least fifteen square millimeters.

4. The traction system of claim 2, wherein said traction elements are made of thermoplastic material, and wherein the volume of thermoplastic material comprising each traction element is at least one hundred cubic millimeters.

5. A traction system for an athletic shoe having an outsole, said system comprising:

a traction cleat having a cleat axis and comprising:

a hub having a perimetric edge, a top surface and a bottom surface;

a hub connection member extending from said top surface and disposed about said cleat axis;

a plurality of spaced dynamic traction elements, each including a proximal section extending outward and slightly downward from a respective location substantially at said perimetric edge, and a distal section extending substantially downwardly from said proximal section, said distal section terminating in a turf-engaging end surface, said dynamic traction elements being sufficiently flexible relative to said hub as to be pivotally flexible in an upward direction about said perimetric edge;

a set of locking posts disposed in angularly spaced relationship in an annular array located concentrically about the cleat axis, each locking post having first and second end walls;

a receptacle having a receptacle axis configured to be secured in the shoe outsole and comprising:

a socket for rotatably receiving and engaging said hub connection member when said cleat axis and receptacle axis are coincident; and a plurality of locking stubs disposed in angularly spaced relationship in an annular array located concentrically about the receptacle axis, wherein each locking stub includes a radially outward facing surface disposed between outwardly projecting leading and trailing end walls;

wherein said cleat has a predetermined final engagement position in relation to said receptacle in which said connection member is fully inserted in said socket;

wherein said locking stubs and locking posts are configured such that, in said final engagement position of said cleat, each locking stub is angularly aligned with and extends at least partially into a space between two respective locking posts and the leading and trailing end walls of each locking stub substantially abut the second end wall of one of said two locking posts and the first end wall of the other of said two locking posts, respectively; and wherein said proximal section of each traction element has a transverse cross-sectional area that varies throughout its length and is between at least twenty square millimeters and thirty square millimeters at a thickest part of said proximal section.

6. The traction system of claim 5, wherein said turf-engaging end surface of each traction element has a surface area of at least fifteen square millimeters.

7. The traction system of claim 5, wherein said traction elements are made of thermoplastic material, and wherein the volume of thermoplastic material comprising each traction element is approximately one-hundred-ninety-seven cubic millimeters.

8. A traction cleat having a cleat axis and comprising:

a hub having a perimetric edge, a top surface and a bottom surface;

a hub connection member extending from said top surface and disposed about said cleat axis;

a plurality of spaced dynamic traction elements, each including a proximal section extending outward and slightly downward from a respective location substantially at said perimetric edge, and a distal section extending substantially downwardly from said proximal section, said distal section terminating in a turf-engaging end surface, said dynamic traction elements being sufficiently flexible relative to said hub as to be pivotally flexible in an upward direction about said perimetric edge;

a set of locking posts disposed in angularly spaced relationship in an annular array located concentrically about the cleat axis, each locking post having an outer surface and a radially inward facing surface disposed between first and second end walls, said inward facing surface having a length and said end walls being oriented approximately perpendicular to said radially inward facing surface, wherein said inward facing surface is slightly concave with a continuous radius of curvature about said cleat axis throughout the length of the inwardly facing surface, and wherein said proximal section has a transverse cross-sectional area that varies throughout its length and at least at some location is between at least twenty square millimeters and thirty square millimeters at a thickest part of said proximal section.

9. The traction cleat of claim 8, wherein said turf-engaging end surface has a surface area of at least twelve square millimeters.

10. The traction cleat of claim 9, wherein said turf-engaging end surface has a surface area of approximately fifteen square millimeters.

11. The traction cleat of claim 9, wherein said traction elements are made of thermoplastic material, and wherein the volume of thermoplastic material comprising each traction element is approximately one-hundred-ninety-seven cubic millimeters.

12. The traction cleat of claim 8, wherein the number of spaced dynamic traction elements in said plurality is six and the number of angularly spaced locking posts in said set is six; and wherein each locking post is angularly aligned with a space between two respective dynamic tractions elements.

13. The traction cleat of claim 8, wherein said hub connection member comprises an externally threaded attachment stem having a two-start thread which is adapted to be attachable within a socket of a receptacle having an interior cavity wall threaded with a two-start thread configured to receive and threadedly engage the external stem thread.

14. The traction system of claim 1, wherein said cleat is rotationally installed in said receptacle in an insertion direction;

wherein said outwardly projecting leading and trailing end walls of each locking stub subtend different respective angles with the outside surface of said boss from which each stub projects; and wherein the angle subtended by said trailing end wall and the boss outside surface is steeper than the angle subtended by said leading end wall and the boss outside surface and impedes rotation between said cleat and said receptacle in a direction opposite the insertion direction.

15. The traction system of claim 5, wherein said socket rotatably receives said hub connection in an insertion direction;

wherein said outwardly projecting leading and trailing end walls of each locking stub subtend different respective angles with an outer surface of said receptacle from which each stub projects; and wherein the angle subtended by said trailing end wall and the receptacle outer surface is steeper than the angle subtended by said leading end wall and the receptacle outer surface and impedes rotation between said cleat and said receptacle in a direction opposite the insertion direction.

16. The traction system of claim 5, wherein said hub connection member comprises an externally threaded attachment stem having a two-start thread and said receptacle socket includes an interior wall threaded with a two-start thread configured to receive and threadedly engage said stem when said cleat axis and receptacle axis are coincident, and wherein the threaded engagement combats higher stresses experienced in field sports.

* * * * *